US009126413B2

(12) United States Patent
Tamaki

(10) Patent No.: US 9,126,413 B2
(45) **Date of Patent: *Sep. 8, 2015**

(54) LIQUID EJECTING APPARATUS

(71) Applicant: BROTHER KOGYO KABUSHIKI KAISHA, Nagoya-shi, Aichi-ken (JP)

(72) Inventor: Shuichi Tamaki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/481,321

(22) Filed: Sep. 9, 2014

(65) Prior Publication Data

US 2015/0054891 A1 Feb. 26, 2015

Related U.S. Application Data

(63) Continuation of application No. 13/954,717, filed on Jul. 30, 2013, now Pat. No. 8,857,955.

(30) Foreign Application Priority Data

Jul. 31, 2012 (JP) ..... 2012-170628

(51) Int. Cl.
*B41J 2/175* (2006.01)
*B41J 29/13* (2006.01)

(52) U.S. Cl.
CPC ..... *B41J 2/175* (2013.01); *B41J 2/1752* (2013.01); *B41J 2/17509* (2013.01)

(58) Field of Classification Search
USPC ..... 347/49, 85, 86, 87, 108, 139
See application file for complete search history.

(56) References Cited

U.S. PATENT DOCUMENTS

| | | | | |
|---|---|---|---|---|
| 5,552,812 | A | 9/1996 | Ebinuma et al. | |
| 5,719,612 | A * | 2/1998 | Hirakue | 347/108 |
| 5,909,226 | A | 6/1999 | Takeda | |
| 6,190,010 | B1 | 2/2001 | Tanaka | |
| 6,443,645 | B1 * | 9/2002 | Takei et al. | 400/621 |

(Continued)

FOREIGN PATENT DOCUMENTS

| | | | |
|---|---|---|---|
| CN | 1758699 | A | 4/2006 |
| CN | 101152799 | A | 4/2008 |
| CN | 102555456 | A | 7/2012 |
| JP | 63-254044 | B2 | 10/1988 |
| JP | 2004-306340 | A | 11/2004 |
| JP | 2004-345307 | A | 12/2004 |
| JP | 2005-088209 | A | 4/2005 |
| JP | 2008-137221 | A | 6/2008 |
| JP | 2010-188734 | A | 9/2010 |

OTHER PUBLICATIONS

U.S. Office Action issued in related U.S. Appl. No. 13/954,819, mailed Jun. 2, 2014.
U.S. Office Action issued in related U.S. Appl. No. 13/954,891, mailed Jun. 2, 2014.
CN Office Action issued in related CN patent application Serial No. 201310328805.4, mailed Nov. 25, 2014.

*Primary Examiner* — Anh T. N. Vo
(74) *Attorney, Agent, or Firm* — Merchant & Gould PC

(57) ABSTRACT

A plurality of second tanks is connected to at least one first-tank mount section so that each of the plurality of second tanks is supplied with liquid stored in a corresponding one of at least one first tank in a state where at least one first tank is mounted on the at least one first-tank mount section. One of the at least one liquid ejecting head is connected to at least two of the plurality of second tanks so that liquid stored in each of the at least two of the plurality of second tanks is supplied to the one of the at least one liquid ejecting head. At least two of the second tanks connected to the one of the at least one liquid ejecting head are arranged such that there is at least one second tank at each side of the liquid ejecting head in the predetermined direction.

19 Claims, 10 Drawing Sheets

(56) References Cited

U.S. PATENT DOCUMENTS

| | | | | |
|---|---|---|---|---|
| 6,942,211 | B2 * | 9/2005 | Teo et al. | 271/145 |
| 7,959,268 | B2 | 6/2011 | Osawa et al. | |
| 8,025,372 | B2 | 9/2011 | Umeda et al. | |
| 8,220,797 | B2 | 7/2012 | Yamamoto et al. | |
| 8,348,403 | B2 * | 1/2013 | Ueda et al. | 347/86 |
| 8,382,277 | B2 * | 2/2013 | Chinzei et al. | 347/108 |
| 8,662,629 | B2 | 3/2014 | Yamamoto | |
| 2006/0076729 | A1 | 4/2006 | Kozaki et al. | |
| 2008/0079786 | A1 | 4/2008 | Umeda | |
| 2008/0316282 | A1 | 12/2008 | Osawa et al. | |
| 2008/0316284 | A1 | 12/2008 | Osawa et al. | |

* cited by examiner

LIQUID EJECTING APPARATUS

CROSS REFERENCE TO RELATED APPLICATIONS

This is a Continuation of application Ser. No. 13/954,717 filed Jul. 30, 2013, which claims priority from Japanese Patent Application No. 2012-170628 filed Jul. 31, 2012. The entire disclosures of the prior applications are hereby incorporated by reference in their entirety.

TECHNICAL FIELD

The invention relates to a liquid ejecting apparatus that ejects liquid from ejection ports.

BACKGROUND

A printer is known in which an upper casing supporting a head and a subsidiary tank that supplies the head with ink is pivotally movable about a pivotal axis, thereby opening a space between an ejection surface of the head and a platen so that a work space for jam recovery or the like can be secured.

SUMMARY

The inventor considered a configuration in which, for ejecting a plurality of colors of ink from one head, for example, a plurality of subsidiary tanks is connected to one head, and found the following issue. Like the above-mentioned printer, if all the subsidiary tanks are arranged at one side of the head in a direction perpendicular to the pivotal axis, a distance from the pivotal axis is different for each of the plurality of subsidiary tanks connected to the one head. In a configuration where the distance from the pivotal axis is different among the subsidiary tanks connected to the one head, when an upper casing is pivotally moved, a positional relationship between each subsidiary tank and the head with respect to the vertical direction varies, and the head differential varies, which tends to cause menisci in ejection ports to being broken. Breakage of menisci may worsen ejection performance. Further, this configuration worsens a weight balance of the upper casing, and may cause a pivotal mechanism of the upper casing to be damaged.

In view of the foregoing, this specification discloses a liquid ejecting apparatus. The liquid ejecting apparatus includes at least one first-tank mount section, a plurality of second tanks, at least one liquid ejecting head, a supporting section, a first casing, and a second casing. The at least one first-tank mount section is configured so that at least one first tank storing liquid is mounted thereon. The at least one liquid ejecting head is elongated in a predetermined direction. The at least one liquid ejecting head has an ejection surface formed with a plurality of ejection ports configured to eject liquid. The supporting section is disposed in confrontation with the ejection surface and configured to support a recording medium. The first casing holds the at least one liquid ejecting head and the plurality of second tanks. The second casing holds the supporting section. The first casing is coupled to the second casing in such a manner that the first casing is movable relative to the second casing by pivotally moving about a pivotal axis that extends in the predetermined direction. The first casing is configured to take a first position at which the ejection surface confronts the supporting section and a second position at which the ejection surface is farther spaced away from the supporting section than at the first position. The plurality of second tanks is connected to the at least one first-tank mount section so that each of the plurality of second tanks is supplied with liquid stored in a corresponding one of the at least one first tank in a state where the at least one first tank is mounted on the at least one first-tank mount section. One of the at least one liquid ejecting head is connected to at least two of the plurality of second tanks so that liquid stored in each of the at least two of the plurality of second tanks is supplied to the one of the at least one liquid ejecting head. At least two of the plurality of second tanks connected to the one of the at least one liquid ejecting head are arranged in such a manner that there is at least one second tank at each side of the one of the at least one liquid ejecting head with respect to the predetermined direction.

BRIEF DESCRIPTION OF THE DRAWINGS

Embodiments in accordance with the invention will be described in detail with reference to the following figures wherein:

FIGS. 1A and 1B are schematic side views showing the internal structure of an inkjet-type printer according to a first embodiment of the invention, wherein FIG. 1A shows a state in which an upper casing is located at a closed position, and FIG. 1B shows a state in which the upper casing is located at an open position;

FIGS. 3A and 3B are schematic side views showing a pivoting operation of the printer shown in FIGS. 1A and 1B, wherein FIG. 3A shows a state in which the upper casing is located at the closed position, and FIG. 3B shows a state in which the upper casing is located at the open position;

FIGS. 4A and 4B are enlarged front views showing a lock mechanism shown in FIGS. 1A and 1B, wherein FIG. 4A shows a state in which the lock mechanism is in an engaged state, and FIG. 4B shows a state in which the lock mechanism is in a non-engaged state;

DETAILED DESCRIPTION

A liquid ejecting apparatus according to some aspects of the invention will be described while referring to the accompanying drawings. In the following description, the expressions "front", "rear", "upper", "lower", "right", and "left" are used to define the various parts when the liquid ejecting apparatus is disposed in an orientation in which it is intended to be used.

First Embodiment

First, the overall configuration of an inkjet-type printer 1 according to a first embodiment will be described while referring to FIGS. 1A through 2B.

Figure 1A:
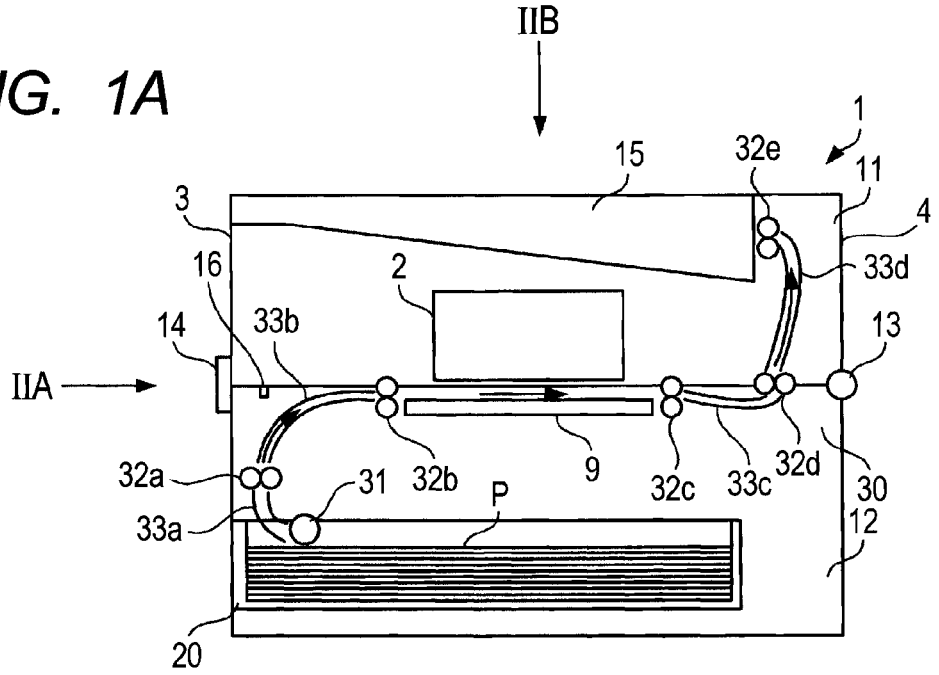
Figure 1B:
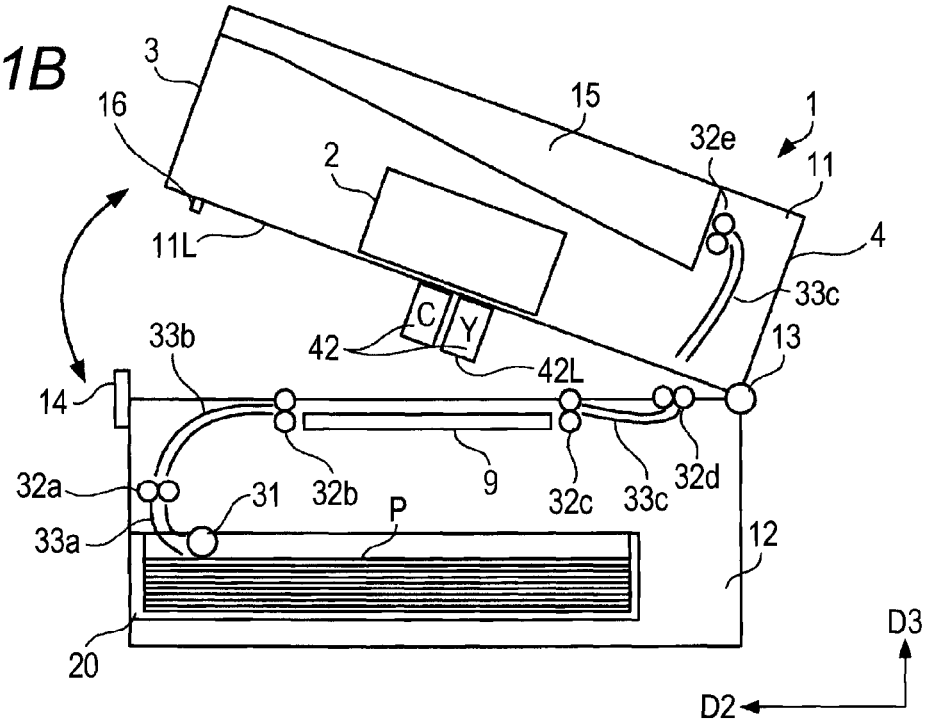

The printer 1 includes an upper casing (first casing) 11 and a lower casing (second casing) 12, both of which have a rectangular-parallelepiped shape. The left-side surface in FIGS. 1A and 1B is a front surface 3. The right-side surface in FIGS. 1A and 1B is a rear surface 4. The lower side of the upper casing 11 is opened, and the upper side of the lower casing 12 is opened. The upper casing 11 is coupled to the lower casing 12 such that the upper casing 11 can pivot about a pivotal shaft 13 (pivotal axis). The upper casing 11 pivotally moves between: a closed position (first position: FIG. 1A) at which the open sides of the upper casing 11 and lower casing 12 are closed so that an internal space of the printer 1 is defined; and an open position (second position: FIG. 1B) at which the internal space of the printer 1 is opened. The closed position is a position at which the ejection surface confronts the platen 9 and at which the upper casing 11 is adjacent to the lower casing 12. The open position is a position at which the ejection surface is farther spaced away from the platen 9 than at the closed position and at which the upper casing 11 is farther spaced away from the lower casing 12 than at the closed position. An open/close sensor 16 is fixed to the lower surface of the upper casing 11. The open/close sensor 16 is configured to output a detection signal when the upper casing 11 is at the closed position, and not to output the detection signal when the upper casing 11 is at the open position. The printer 1 includes a lock mechanism 14 that restricts pivotal movement of the upper casing 11 when the upper casing 11 is at the closed position. The lock mechanism 14 can lock/unlock under controls of a controller 1*p* (see FIGS. 4A and 4B). The lock mechanism 14 will be described later in detail. A paper discharge section 15 is provided at the upper surface of the upper casing 11. Sheets of paper P on which printing is finished are discharged sequentially onto the paper discharge section 15.

In the internal space of the printer 1, four ink-cartridge mount sections 41*a* (first-tank mount section), four subsidiary tanks 42 (second tanks) each having smaller volume than volume of each ink cartridge 41, an inkjet head 2, a paper tray 20, a paper conveying mechanism 30, a platen 9, and a waste liquid tank 47 are arranged.

Four ink cartridges 41 storing ink in different kinds (Y: yellow, C: cyan, M: magenta, Bk: black) are mounted on respective ones of the four ink-cartridge mount sections 41*a*. Each of the ink-cartridge mount sections 41*a* is fixed to the lower casing 12. Four ink-cartridge mount sections 41*a* are arranged at the same height. Each of the ink-cartridge mount sections 41*a* has two needles 17*a* and 17*b* (connection section) that are inserted into the ink cartridge 41 when the ink cartridge 41 is mounted. The needles 17*a* and 17*b* are arranged at positions of each ink-cartridge mount section 41*a* that confronts a surface 41*b* of the ink cartridge 41 at the rear surface 4 side, in a state where the ink cartridge 41 is mounted on the ink-cartridge mount section 41*a*. Each of the needles 17*a* and 17*b* extends in a sub-scanning direction D2. Each ink-cartridge mount section 41*a* is disposed at the rear surface 4 side of the ink cartridge 41 mounted on the corresponding ink-cartridge mount section 41*a*. Further, the ink-cartridge mount section 41*a* is disposed at the rear surface 4 side of the subsidiary tanks 42 with respect to the sub-scanning direction D2. Further, two of the four ink-cartridge mount sections 41*a* are arranged at each outer side of the inkjet head 2 with respect to a main scanning direction D1. In other words, two of the four ink-cartridge mount sections 41*a* are arranged in each first range R1 (see FIGS. 2A and 2B) which is a range not overlapping the inkjet head 2 with respect to the main scanning direction D1. Here, a range overlapping the inkjet head 2 with respect to the main scanning direction D1 is referred to as a second range R2. In other words, the first range R1 is defined as a range, with respect to the main scanning direction D1, other than a range in which the inkjet head 2 extends. The second range R2 is defined as a range, with respect to the main scanning direction D1, in which the inkjet head 2 extends. The ink cartridge 41 has substantially a rectangular-parallelepiped shape. Because each ink cartridge 41 is mounted on the ink-cartridge mount section 41*a* fixed to the lower casing 12, the ink cartridge 41 mounted on the ink-cartridge mount section 41*a* is held by the lower casing 12. When the four ink cartridges 41 are mounted on the respective four ink-cartridge mount sections 41*a*, the longitudinal direction of each ink cartridge 41 is in the sub-scanning direction D2 that is perpendicular to a direction in which the pivotal shaft 13 extends (hereinafter, referred to as the main scanning direction DD. When the ink cartridge 41 is mounted on the ink-cartridge mount section 41*a*, the length in the sub-scanning direction D2 is the longest. The length in a vertical direction D3 is the second longest, and the length in the main scanning direction D1 is the shortest. Further, when mounted on the ink-cartridge mount sections 41*a*, two of the four ink cartridges 41 are arranged at each outer side of the inkjet head 2 with respect to the main scanning direction D1. In other words, when mounted on the ink-cartridge mount sections 41*a*, two of the four ink cartridges 41 are arranged in each first range R1. The direction in which the pivotal shaft 13 extends is an example of a predetermined direction. Specifically, the yellow and cyan ink cartridges 41 are arranged at a bottom portion of the lower casing 12 at the left side (FIGS. 2A and 2B) in the main scanning direction D1, whereas the magenta and black ink cartridges 41 are arranged at the right side in FIGS. 2A and 2B. The four ink cartridges 41 are arranged at the same height. The ink cartridge 41 can be mounted on the ink-cartridge mount section 41*a* by inserting the ink cartridge 41 in the sub-scanning direction D2 from the front surface of the lower casing 12, i.e., from the front surface 3 side toward the rear surface 4 side. That is, the insertion direction of the ink cartridge 41 is the sub-scanning direction D2.

Each of the four subsidiary tanks 42 has substantially a rectangular-parallelepiped shape. Each subsidiary tank 42 is fixed to the upper casing 11. Each subsidiary tank 42 has a length in the main scanning direction D1 and a length in the vertical direction D3 that are substantially the same and that are longer than the length in the sub-scanning direction D2. As shown in FIGS. 3A and 3B, an ink inlet port 42*i* through which ink supplied from the ink cartridge 41 flows in is formed on an upper surface of each subsidiary tank 42. A liquid level sensor 42*b* that detects a liquid level of ink stored therein is disposed within the subsidiary tank 42. The ink inlet port 42*i* is formed at a position on the upper surface of the subsidiary tank 42, the position being farthest away from the pivotal shaft 13. When the upper casing 11 is located at the open position, the ink inlet port 42*i* is located at a higher position than a highest liquid level of ink stored in the subsidiary tank 42 with respect to the vertical direction D3 (FIG. 3B). The highest liquid level of ink stored in the subsidiary tank 42 is a liquid level of ink in a state where ink stored in the subsidiary tank 42 is the maximum amount. In the present embodiment, a predetermined amount means that an ink storage amount of the subsidiary tank 42 is the maximum amount. Note that the predetermined amount may also be any amount that is smaller than the maximum amount. The highest liquid level may be, for example, determined by supplying ink to the subsidiary tank 42 by a pump 43 based on a detection output of the liquid level sensor 42*b*, or may be determined based on the structure of the subsidiary tank 42 (for example, a discharge hole formed on a side surface of the subsidiary tank 42 near the highest liquid level for discharging ink in the subsidiary tank 42 that exceeds the predetermined amount). In the present embodiment, because the ink inlet port 42*i* is formed at the position on the upper surface of the subsidiary tank 42, the position being farthest away from the pivotal shaft 13, the highest liquid level of the subsidiary tank 42 can be made relatively higher, and hence the storage amount of the subsidiary tank 42 can be made larger. The ink inlet ports 42*i* of the four subsidiary tanks 42 and the corresponding ink-cartridge mount sections 41*a* are connected with each other via tubes 43*a* (first tube). Further, the tubes 43*a* and the corresponding ink cartridges 41 are connected with each other via the needles 17*a*. Note that rigidity of the tube 43*a* is lower than rigidity of a tube 42*a* that connects the subsidiary tank 42 and the inkjet head 2 (see FIGS. 2A and 2B). An atmosphere communication opening 42*c* is formed at the upper surface of each subsidiary tank 42. A valve 42*d* is provided at the atmosphere communication opening 42*c*. When the valve 42*d* is opened, a space within the subsidiary tank 42 is communicated with the atmosphere via the atmosphere communication opening 42*c*. When the valve 42*d* is closed, the space within the subsidiary tank 42 is blocked from the atmosphere. An ink outlet port 42*e* is formed on a side surface of each subsidiary tank 42. The ink outlet port 42*e* is formed at a lower end portion of the side surface of the subsidiary tank 42. The ink outlet port 42*e* and the corresponding ink-cartridge mount section 41*a* are connected with each other via a tube 43*b*. Further, the tube 43*b* and the corresponding ink cartridge 41 are connected with each other via the needle 17*b*. The rigidity of the tube 43*b* is the same as the rigidity of the tube 43*a*. In FIGS. 3A and 3B, although the above configuration is shown only for one subsidiary tank 42, the other subsidiary tanks 42 have similar configurations.

Figure 2A:
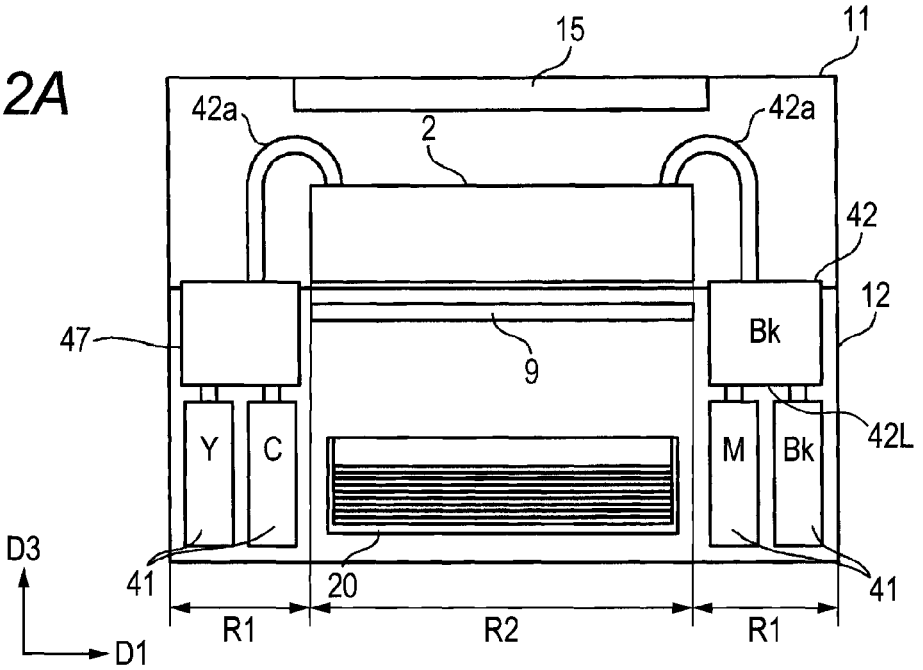
FIG. 2A is a schematic front view showing the internal structure of the printer, as viewed from the direction shown by an arrow IIA in FIG. 1A.
Figure 2B:
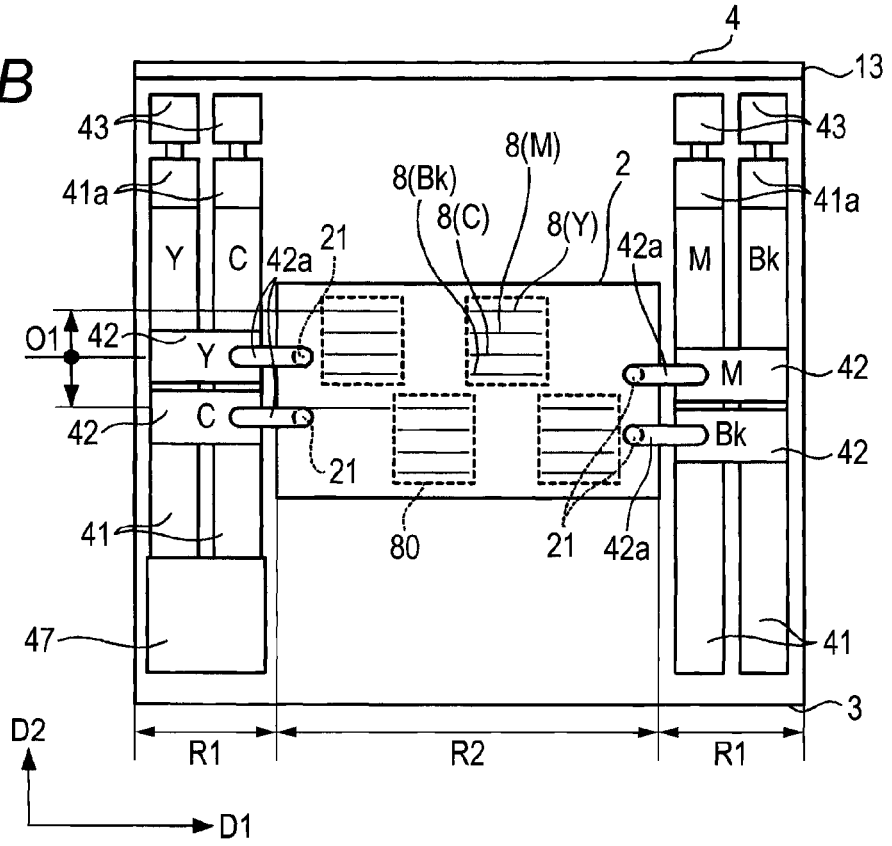
FIG. 2B is a schematic plan view showing the internal structure of the printer, as viewed from the direction shown by an arrow IIB in FIG. 1A.
Figure 3A:
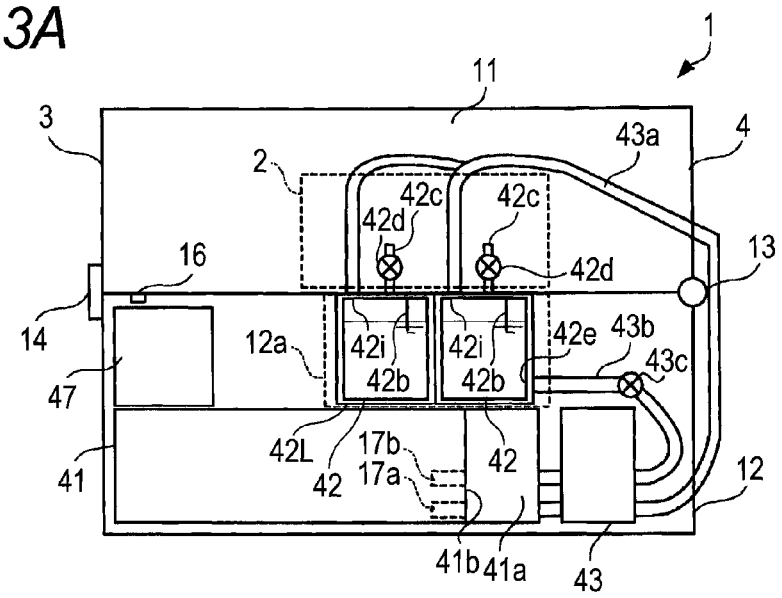
Figure 3B:
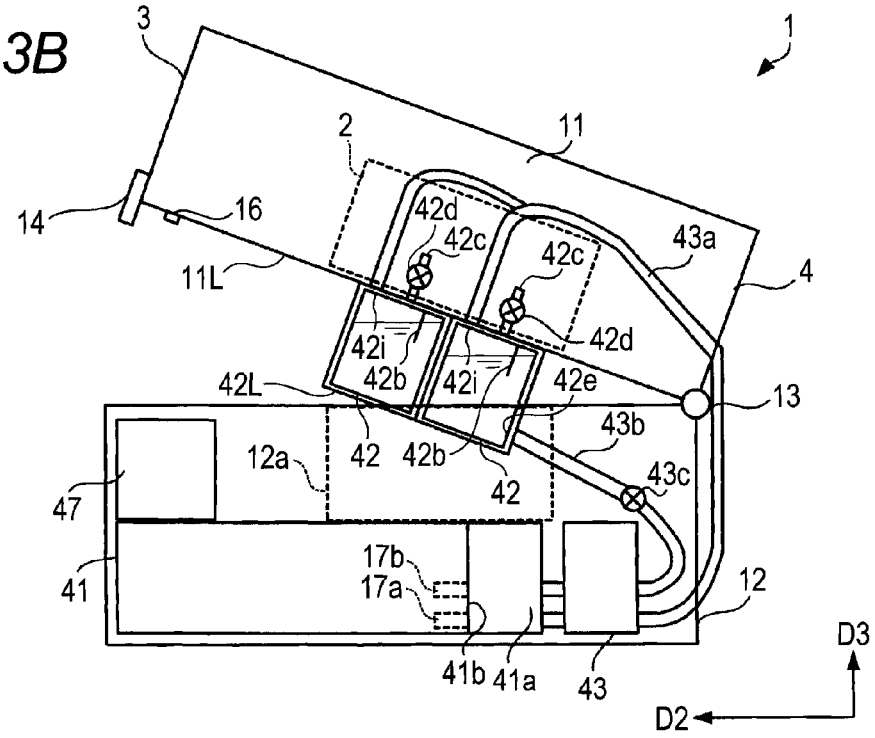

As shown in FIGS. 1A through 2B, two of the four subsidiary tanks 42 are arranged at each outer side of the inkjet head 2 with respect to the main scanning direction D1. In other words, two of the four subsidiary tanks 42 are arranged in each first range R1. Each subsidiary tank 42 is arranged at a position overlapping the ink cartridge 41 mounted on the corresponding ink-cartridge mount section 41*a* in the vertical direction D3. As shown in FIG. 2B, in a plan view, each subsidiary tank 42 is arranged at a position overlapping the inkjet head 2 in the main scanning direction D1. Specifically, the yellow and cyan subsidiary tanks 42 are arranged, in this order from the rear surface 4 side, at the upper casing 11 at the left side (FIG. 2B) in the main scanning direction D1, whereas the magenta and black subsidiary tanks 42 are arranged, in this order from the rear surface 4 side, at the right side. When the upper casing 11 is located at the closed position, the four subsidiary tanks 42 are arranged at the same height. Note that the magenta and black subsidiary tanks 42 are omitted in FIGS. 1A and 1B for simplicity. Each subsidiary tank 42 is arranged in such a manner that a liquid level of each subsidiary tank 42 is located at a lower position than the ejection surface of the inkjet head 2, so as to keep the liquid level of each subsidiary tank 42 and the ejection surface of the inkjet head 2 within a predetermined range of head differential. Hence, the subsidiary tank 42 protrudes from the lower surface of the upper casing 11. Note that the lower casing 12 is formed with a concave region 12*a* (concave portion) in which protruding portions of the subsidiary tanks 42 are inserted when the upper casing 11 is located at the closed position.

The pump 43 is provided at a middle portion of the tube 43*a*. The pump 43 is fixed to the lower casing 12. The pump 43 is disposed at the rear surface 4 side of the corresponding ink-cartridge mount section 41*a* (the downstream side in an insertion direction of the ink cartridge 41). The pump 43 is disposed at a position overlapping the ink cartridge 41 and the ink-cartridge mount section 41*a* in the sub-scanning direction D2. By driving the pump 43 as necessary, ink is supplied to the subsidiary tank 42 from the ink cartridge 41 mounted on the corresponding ink-cartridge mount section 41*a*.

A valve 43*c* is provided at a middle portion of the tube 43*b*. When the valve 43*c* is opened, a space within the subsidiary tank 42 is communicated with the corresponding ink cartridge 41. When the valve 43*c* is closed, the space within the subsidiary tank 42 is blocked from the corresponding ink cartridge 41. When the valve 42*d* and the valve 43*c* are opened, ink in the subsidiary tank 42 is returned to the corresponding ink cartridge 41 due to the head differential between the subsidiary tank 42 and the corresponding ink cartridge 41. In modifications of the embodiment, the tube 43*b*, the valve 42*d*, the valve 43*c*, the needle 17*b*, or the atmosphere communication opening 42*c* may be omitted.

The inkjet head 2 has substantially a rectangular-parallelepiped shape. The inkjet head 2 is held by the upper casing 11. The inkjet head 2 is disposed at substantially a center portion of the upper casing 11 with respect to the sub-scanning direction D2. The inkjet head 2 has, at its lower surface, an ejection surface in which a plurality of ejection ports 8 for ejecting ink droplets is formed. The ejection surface of the inkjet head 2 is located at approximately the same position as the lower end of the upper casing 11 with respect to the vertical direction D3. The ejection surface of the inkjet head 2 has a plurality of ejection-port arrays. In each ejection-port array, the plurality of ejection ports 8 is arranged at equal intervals along the main scanning direction D1. Four ink supply ports 21 are formed at the upper surface of the inkjet head 2. The four ink supply ports 21 are arranged to be point-symmetrical with respect to the center of the inkjet head 2. The four ink supply ports 21 are connected with the respective ones of the four subsidiary tanks 42 via the tubes 42*a* (second tube). Two of the four subsidiary tanks 42 are arranged at each outer side of the inkjet head 2 with respect to the main scanning direction D1. The ink supply ports 21 arranged at one side of the ejection surface with respect to the main scanning direction D1 are connected with the subsidiary tanks 42 arranged at the one side of the inkjet head 2 with respect to the main scanning direction D1 via the tubes 42*a* (second tube). The ink supply ports 21 arranged at the other side of the ejection surface with respect to the main scanning direction D1 are connected with the subsidiary tanks 42 arranged at the other side of the inkjet head 2 with respect to the main scanning direction D1 via the tubes 42*a* (second tube).

Four ink channels (not shown) are formed inside the inkjet head 2. The four ink channels are communicated with the different ink supply ports 21, and extend in a direction in which the pivotal shaft 13 extends (the main scanning direction DD. Each ink channel is communicated with the plurality of ejection ports 8 via pressure chambers (not shown). Actuators (not shown) apply pressure to the pressure chambers, which causes ink droplets to be ejected from the ejection ports 8.

A plurality of ejection blocks 80 in staggered arrangement with respect to the main scanning direction D1 is defined in the ejection surface of the inkjet head 2. Each ejection block 80 includes ejection-port arrays (ejection-port groups) for the respective ones of the ink cartridges 41, in other words, for kinds of ink (Y, C, M, Bk). In each of the ejection-port arrays, the ejection ports 8 are arranged at equal intervals in the main scanning direction D1. That is, the number of the ejection-port arrays and the number of the subsidiary tanks 42 are the same, which is four. The four ejection-port arrays in each ejection block 80 are arranged in the sub-scanning direction D2, which is perpendicular to the main scanning direction D1. The arrangement sequence of the ejection-port arrays of the respective kinds of ink is the same for all the ejection blocks 80. Specifically, in each ejection block 80, the four ejection-port arrays are arranged in the sequence of Y, M, C, Bk from the rear surface 4 side, with respect to the kinds of ink. This arrangement sequence (Y→M→C→Bk from the rear surface 4 side) is the same as the arrangement sequence of the subsidiary tanks 42 with respect to the kinds of ink. Specifically, two subsidiary tank 42 at the left side of FIG. 2B are arranged in a sequence of Y, C from the rear surface 4 side with respect to the kinds of ink, and this sequence is the same as the arrangement sequence of the ejection-port arrays for Y, C. Similarly, two subsidiary tank 42 at the right side of FIG. 2B are arranged in a sequence of M, Bk from the rear surface 4 side with respect to the kinds of ink, and this sequence is the same as the arrangement sequence of the ejection-port arrays for M, Bk. Further, the four subsidiary tanks 42 are arranged in a sequence of Y, M, C, Bk from the rear surface 4 side, and this sequence is the same as the arrangement sequence of the four ejection-port arrays. Further, an average position, with respect to the sub-scanning direction D2, of all the ejection ports 8 in communication with one subsidiary tank 42 matches a center position of the subsidiary tank 42 with respect to the sub-scanning direction D2. Note that the average position is an average of positions, with respect to the sub-scanning direction D2, of all the ejection ports 8 in communication with one subsidiary tank 42. Here, the subsidiary tank 42 and the ejection ports 8 corresponding to yellow (Y) will be described as an example. An average position O, with respect to the sub-scanning direction D2, of the plurality of ejection-port arrays of yellow in all the ejection block 80 matches a center position of the subsidiary tank 42 of yellow with respect to the sub-scanning direction D2. In other words, an average position O1, with respect to the sub-scanning direction D2, of the plurality of ejection ports 8 of yellow in all the ejection blocks 80 matches the center position of the subsidiary tank 42 of yellow with respect to the sub-scanning direction D2. For each of magenta (M), cyan (C), and black (Bk), the average position matches the center position. In this way, the four ejection-port arrays in each ejection block 80 are arranged in the sub-scanning direction D2, in such a manner that an average position, with respect to the sub-scanning direction D2, of all the ejection ports 8 for ejecting ink droplets of the same kind differs for each kind (color) of ink with respect to the sub-scanning direction D2.

In the present embodiment, each ejection block 80 includes one ejection-port array for each kind of ink. However, each ejection block 80 may include a plurality of ejection-port arrays for each kind of ink. In the present embodiment, the positions, with respect to the sub-scanning direction D2, of the two subsidiary tanks 42 located at the rear surface 4 side (the two subsidiary tanks 42 for Y and M) are different, but these positions may be the same. Similarly, in the present embodiment, the positions, with respect to the sub-scanning direction D2, of the two subsidiary tanks 42 located at the front surface 3 side (the two subsidiary tanks 42 for C and Bk) are different, but these positions may be the same. In this case, the average position, in the sub-scanning direction D2, of all the ejection ports 8 in communication with one subsidiary tank 42 may be different from the center position of that subsidiary tank 42 in the sub-scanning direction D2.

The paper tray 20 is configured to hold a plurality of sheets of paper P that are stacked. The paper tray 20 is detachably disposed at the bottom of the lower casing 12 in such a manner that the paper tray 20 is interposed between the ink cartridges 41 from the both sides in the main scanning direction D1. The paper tray 20 can be mounted or dismounted through the front surface of the lower casing 12 in the sub-scanning direction D2. The paper tray 20 is disposed at a position overlapping the inkjet head 2 in the vertical direction D3. In other words, the paper tray 20 is disposed in the second range R2. The paper tray 20 is disposed at a position overlapping the ink cartridges 41 in the main scanning direction D1.

The platen 9 is a plate member for supporting paper P. The platen 9 is fixed to the lower casing 12 in such a manner that the platen 9 confronts the ejection surface of the inkjet head 2 when the upper casing 11 is at the closed position. When the upper casing 11 is at the open position, the ejection surface of the inkjet head 2 is farther spaced away from the platen 9 than at the closed position. The size of the platen 9 in the main scanning direction D1 and in the sub-scanning direction D2 is slightly larger than the size of the ejection surface. The platen 9 is disposed at a position overlapping the inkjet head 2 in the vertical direction D3. In other words, the platen 9 is disposed in the second range R2. The platen 9 is disposed at a higher position, with respect to the vertical direction D3, than the lower end portion of the subsidiary tank 42 when the upper casing 11 is at the closed position. Also, the platen 9 is disposed at a lower position, with respect to the vertical direction D3, than the subsidiary tank 42 when the upper casing 11 is at the open position.

The paper conveying mechanism 30 constitutes a conveying path of paper P starting from the paper tray 20, passing between the inkjet head 2 and the platen 9, and reaching the paper discharge section 15. The paper conveying mechanism 30 includes a pickup roller 31, nip rollers 32*a*-32*e*, and guides 33*a*-33*d*. The pickup roller 31 sends sheets of paper P stacked on the paper tray 20 one sheet at a time from the top. The nip rollers 32*a*-32*e* are arranged along the conveying path and apply conveying force to paper P. The guides 33*a*-33*d* are arranged on the conveying path between the pickup roller 31 and the nip rollers 32*a*-32*e*, respectively. The guides 33*a*-33*d* guide paper P until paper P applied with conveying force by one of the nip rollers 32*a*-32*e* reaches the next (downstream) one of the nip rollers 32*a*-32*e*. When paper P being conveyed by the paper conveying mechanism 30 passes between the inkjet head 2 and the platen 9, an image is printed on the paper P with ink droplets that are ejected from the ejection ports 8 of the inkjet head 2. The paper P on which the image is printed is further conveyed by the paper conveying mechanism 30, and is discharged onto the paper discharge section 15. The pickup roller 31, the nip rollers 32*a*-32*d*, and the guides 33*a*-33*c* are fixed to the lower casing 12. The nip roller 32*e* and the guide 33*d* are fixed to the upper casing 11.

The waste liquid tank 47 has substantially a rectangular-parallelepiped shape. The waste liquid tank 47 stores waste ink that is discharged from the ejection ports 8 of the inkjet head 2. Waste ink is generated due to a maintenance operation for preventing clogging or the like of the ejection ports 8 of the inkjet head 2 (for example, a purge operation of discharging a large amount of ink from the ejection ports 8, etc.). The waste liquid tank 47 is disposed at an outer side of the inkjet head 2 and at the left side of FIG. 2B. In other words, the waste liquid tank 47 is disposed in the first range R1. The waste liquid tank 47 is disposed above the ink cartridge 41 (Y) and the ink cartridge 41 (C), and overlaps the ink cartridges 41 in the vertical direction D3. The waste liquid tank 47 is disposed at a position overlapping the subsidiary tanks 42 when the upper casing 11 is at the closed position (that is, the concave region 12*a*) in the sub-scanning direction D2, and is disposed at the front surface 3 side of the subsidiary tanks 42 when the upper casing 11 is at the closed position (that is, the concave region 12*a*). With this arrangement, the waste liquid tank 47 can be replaced easily. Further, because the waste liquid tank 47 is disposed at a position overlapping the concave region 12*a* in the sub-scanning direction D2, a space near the concave region 12*a* can be utilized efficiently.

Next, the lock mechanism 14 will be described in detail with reference to FIGS. 4A through 5. The lock mechanism 14 includes a cylindrical-shaped rotational member 85, two interlocking members 86*a* and 86*b*, swing members 87*a* and 87*b*, springs 89*a* and 89*b*, fixing members 88*a* and 88*b*, and shaft members 88*c* and 88*d*. The upper casing 11 holds the rotational member 85, the interlocking members 86*a* and 86*b*, the swing members 87*a* and 87*b*, and the springs 89*a* and 89*b*. The lower casing 12 holds the fixing members 88*a* and 88*b* and the shaft members 88*c* and 88*d*. Each of the interlocking members 86*a* and 86*b* has one end, in the longitudinal direction, that is coupled to a circumferential surface of the rotational member 85. The swing members 87*a* and 87*b* are coupled to the other ends, in the longitudinal direction, of the respective interlocking members 86*a* and 86*b*. The swing members 87*a* and 87*b* have concave portions 87*c* and 87*d* configured to engage the shaft members 88*c* and 88*d*, respectively. The springs 89*a* and 89*b* are coupled to upper ends of the swing members 87*a* and 87*b*, respectively. The fixing members 88*a* and 88*b* protrude toward the rotational member 85 from the lower casing 12. The shaft members 88*c* and 88*d* extend in the sub-scanning direction D2. The shaft members 88*c* and 88*d* are fixed to the fixing members 88*a* and 88*b*, and are configured to engage the concave portions 87*c* and 87*d*, respectively.

A rod-like knob 90 is fixed to the front surface of the rotational member 85. The knob 90 can be rotated manually by a user, and rotates integrally with the rotational member 85. An unlock switch 51 that can be pressed by a user is provided at the rotational center of the knob 90. As shown in FIG. 5, the lock mechanism 14 is provided with a solenoid 91 that restricts rotation of the knob 90 by restricting rotation of the rotational member 85. In a state where the solenoid 91 is not energized, the solenoid 91 becomes a state in which a plunger 91*a* engages a concave portion 85*a* formed in a rear surface of the rotational member 85 (a state shown by the solid lines in FIG. 5). In a state where the solenoid 91 is energized, the solenoid 91 becomes a state in which the plunger 91*a* does not engage the concave portion 85*a* (a state shown by the dotted line in FIG. 5). In a state where the solenoid 91 is not energized, because the plunger 91*a* engages the concave portion 85*a*, rotation of the rotational member 85 is restricted (prohibited). When the solenoid 91 is energized, because the plunger 91*a* does not engage the concave portion 85*a*, rotation of the rotational member 85 is allowed.

The springs 89*a* and 89*b* urges the swing members 87*a* and 87*b* in such a direction that the upper ends of the swing members 87*a* and 87*b* approach the rotational member 85, respectively. With this configuration, in the absence of external forces, each section of the lock mechanism 14 remains still in a state where the knob 90 extends in the vertical direction D3 as shown in FIG. 4A.

The knob 90 is normally in a rotation restricted state in which rotation is restricted by the solenoid 91, and is switched from the rotation restricted state to a rotation allowed state due to driving controls of the solenoid 91 by the controller 1*p*. For example, when a user presses the unlock switch 51 for performing a maintenance operation such as jam recovery (work for recovering from jamming of paper P in the paper conveying path) or the like, a restriction cancel signal indicating that restriction by the lock mechanism 14 is canceled is outputted to the controller 1*p* from an unlock sensor 52 (see FIG. 6) that is built in the unlock switch 51. In addition, even if the user does not press the unlock switch 51, the controller 1*p* can detect occurrence of a jam (jamming of paper P in the paper conveying path) in a recording mode and, upon detection of occurrence of a jam, determines that the restriction cancel signal has been received. Specifically, the controller 1*p* detects occurrence of a jam based on signals from a paper sensor (not shown) disposed on the conveying path or a driving motor of the nip rollers 32*a*-32*e*. When the controller 1*p* detects occurrence of a jam, the controller 1*p* executes processes by considering a signal outputted from the paper sensor etc. as the restriction cancel signal. In the present embodiment, the unlock sensor 52 and the paper sensor etc. in a case of detecting occurrence of a jam constitute output means for outputting the restriction cancel signal to the controller 1*p*. Upon receiving the restriction cancel signal, the controller 1*p* drives the solenoid 91 to switch the knob 90 from the rotation restricted state to the rotation allowed state.

Figure 4A:
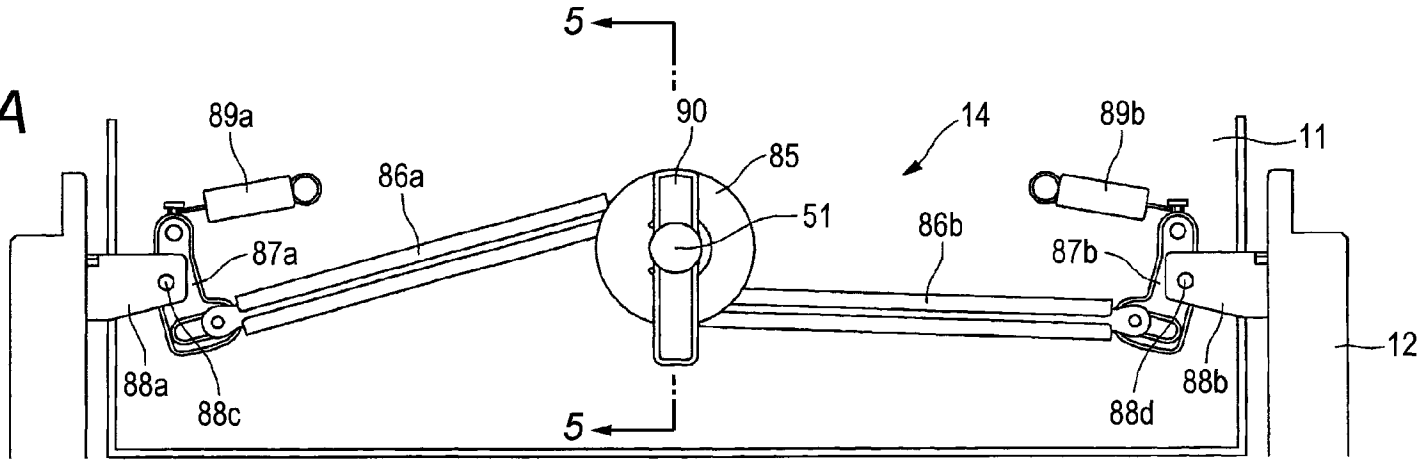
Figure 5:
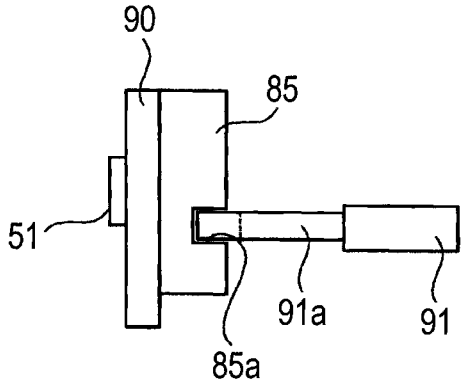
FIG. 5 is a cross-sectional view along a line V-V in FIG. 4A.

In the lock mechanism 14 in a state shown in FIG. 4A, the concave portions 87*c* and 87*d* of the swing members 87*a* and 87*b* engage the shaft members 88*c* and 88*d*, respectively. This engagement restricts movement of the upper casing 11, so as to prevent the upper casing 11 at the closed position (adjacent position) from pivotally moving toward the open position (spaced position).

Figure 4B:
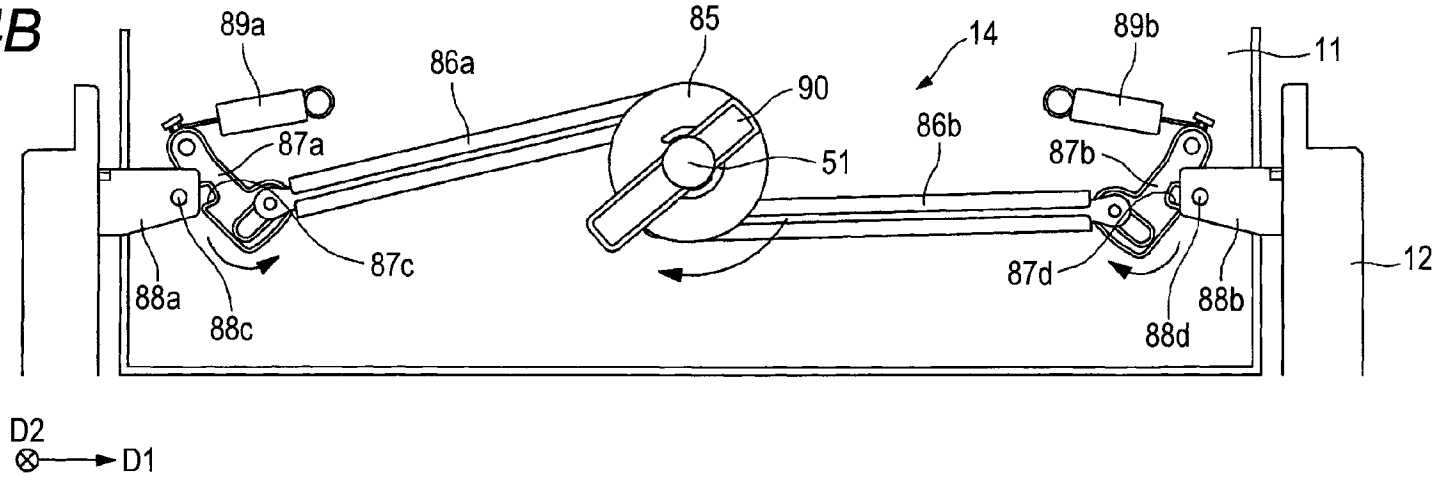

When a user rotates the knob 90 in the rotation allowed state clockwise against the urging force of the springs 89*a* and 89*b*, the interlocking members 86*a* and 86*b* move as shown in FIG. 4B. When the interlocking members 86*a* and 86*b* move, the swing members 87*a* and 87*b* swing so that the concave portions 87*c* and 87*d* separate from the shaft members 88*c* and 88*d*. With this movement, the concave portions 87*c* and 87*d* of the swing members 87*a* and 87*b* are disengaged from the shaft members 88*c* and 88*d* (that is, restriction of movement of the upper casing 11 in the closed position (adjacent position) is canceled), and the user can manually move the upper casing 11 from the closed position to the open position. When the upper casing 11 is at the open position, a detection signal from the open/close sensor 16 is not transmitted to the controller 1*p*, and the controller 1*p* determines that the upper casing 11 is at the open position.

On the other hand, once the user manually moves the upper casing 11 to return from the open position to the closed position, the urging force of the springs 89*a* and 89*b* causes engagement between the shaft members 88*c*, 88*d* and the concave portions 87*c*, 87*d* of the swing members 87*a*, 87*b* to be restored automatically. When the upper casing 11 is at the closed position, the open/close sensor 16 outputs a detection signal to the controller 1*p*. Then, the controller 1*p* determines that the upper casing 11 is returned from the open position to the closed position (at this time, engagement between the shaft members 88*c*, 88*d* and the concave portions 87*c*, 87*d* of the swing members 87*a*, 87*b* is also restored), and controls the solenoid 91 to switch the knob 90 from the rotation allowed state to the rotation restricted state. In this way, restriction of movement of the upper casing 11 is started. As described above, the detection signal from the open/close sensor 16 is a restriction start signal indicating that restriction of movement of the upper casing 11 is started.

As described above, as the overall configuration, when the upper casing 11 is located at the closed position, the subsidiary tanks 42 and the ink cartridges 41 are arranged, in this sequence from the top, to overlap each other in a plan view, within the first range R1 not overlapping the inkjet head 2 with respect to the main scanning direction D1. The inkjet head 2, the platen 9, and the paper tray 20 are arranged, in this sequence from the top, to overlap each other in a plan view, within the second range R2 overlapping the inkjet head 2 with respect to the main scanning direction D1.

As shown in FIGS. 3A and 3B, when the inside of the printer 1 need to be opened for the maintenance operation, such as when paper P is jammed on the conveying path, the user pivotally moves the upper casing 11 from the closed position to the open position (described later). With this operation, the space between the inkjet head 2 and the platen 9 is opened, so that the maintenance operation can be performed easily.

Figure 6:
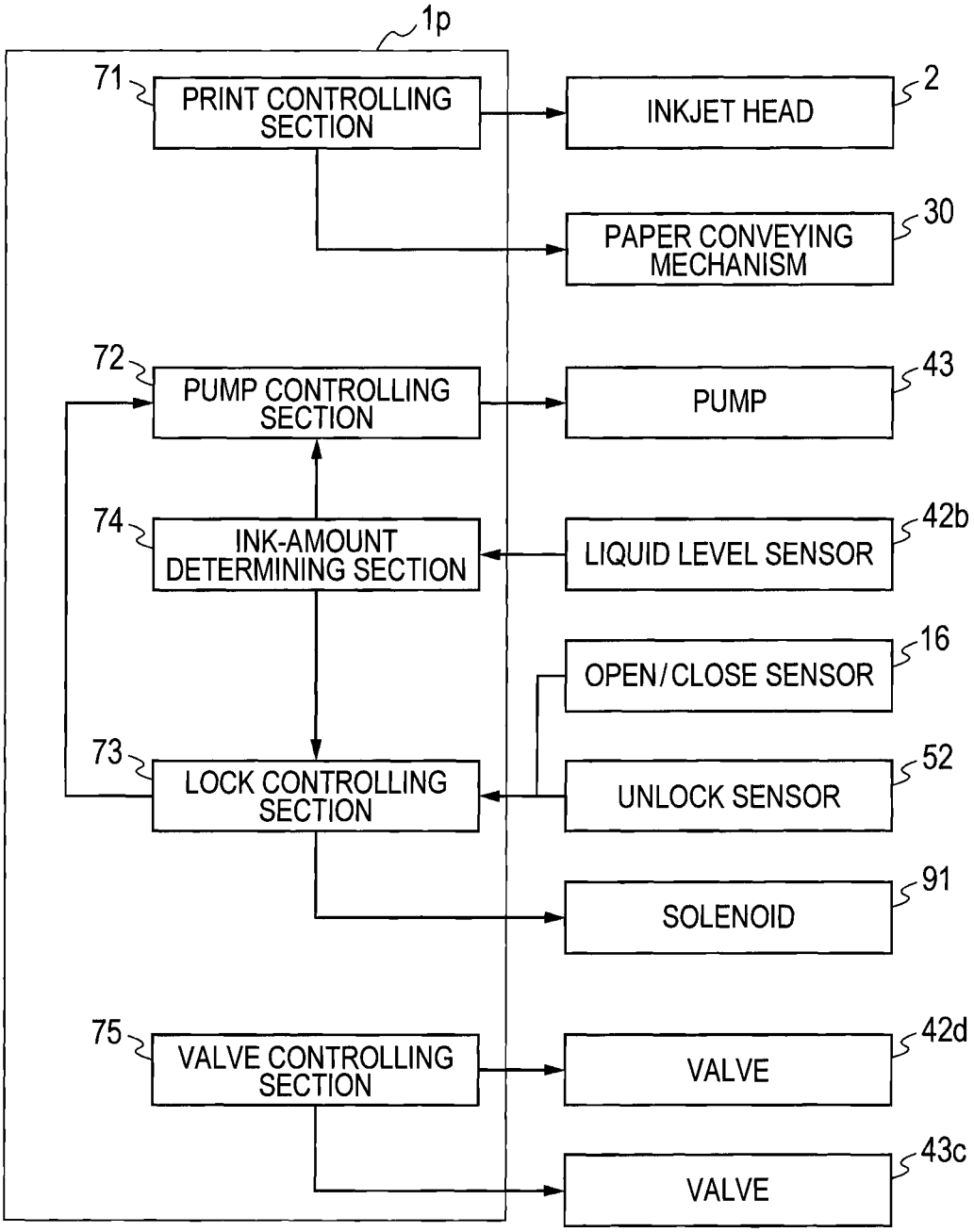
FIG. 6 is a control block diagram of the printer shown in FIGS. 1A and 1B.

Next, the controller 1*p* for controlling the printer 1 will be described. As shown in FIG. 6, the controller 1*p* includes a print controlling section 71, an ink-amount determining section 74, a pump controlling section 72, a lock controlling section 73, and a valve controlling section 75 (return controlling section). The print controlling section 71 controls operations of the inkjet head 2 and the paper conveying mechanism 30, so that a desired image is printed on paper P. The ink-amount determining section 74 determines an amount of ink stored in the subsidiary tank 42, based on a detection result of the liquid level sensor 42*b* of the subsidiary tank 42. The pump controlling section 72 controls driving of the pump 43. Specifically, upon pressing of the unlock switch 51 to be described later, the pump controlling section 72 drives the pump 43 so that ink is supplied from the ink cartridge 41 to the subsidiary tank 42, if the amount of ink determined by the ink-amount determining section 74 is less than a predetermined amount. When the amount of ink stored in the subsidiary tank 42 becomes the predetermined amount, the pump controlling section 72 stops driving of the pump 43. The lock controlling section 73 controls the solenoid 91 based on a state of the unlock switch 51 and on a determination result of the ink-amount determining section 74. The valve controlling section 75 controls opening/closing of the valves 42*d* and 43*c*.

Figure 7:
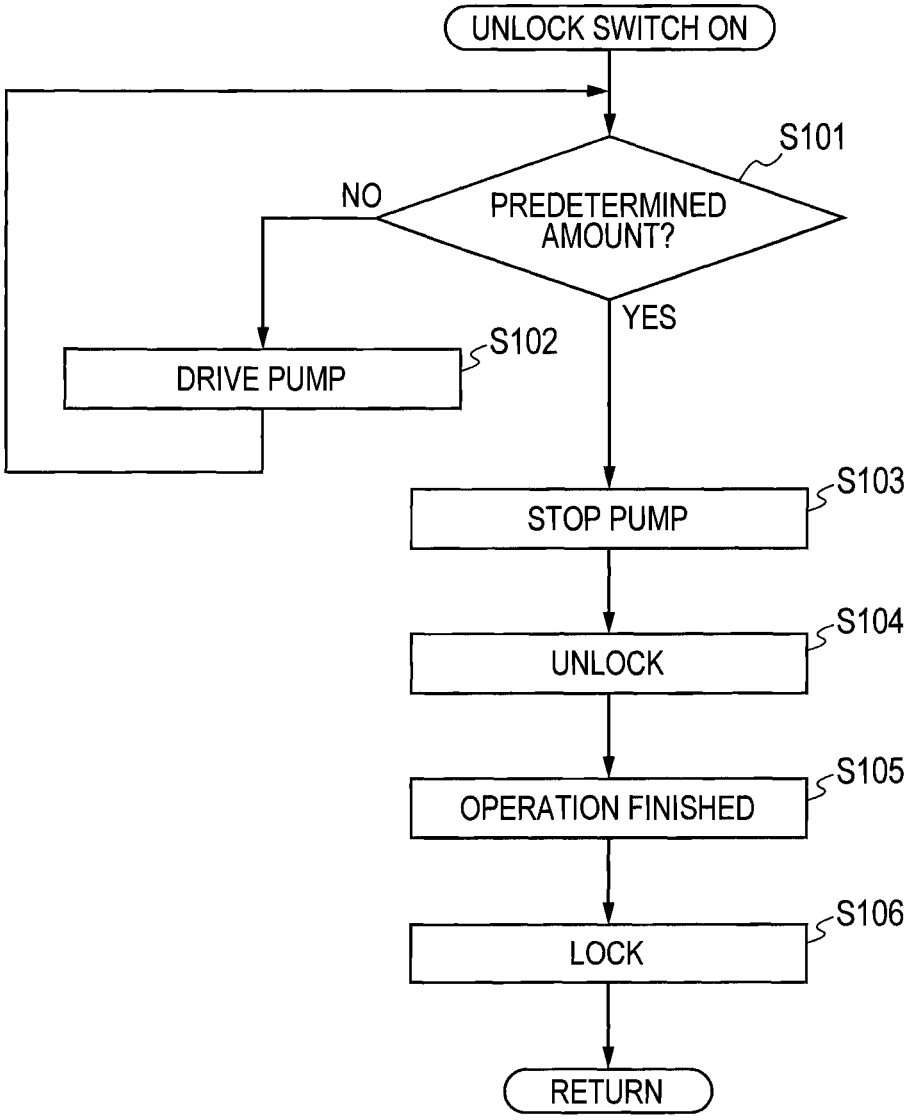
FIG. 7 is a flowchart showing processes performed during a maintenance operation of the printer shown in FIGS. 1A and 1B.

The operations of the printer 1 will be described in a case where a user voluntarily performs the maintenance operation. Basically, the subsidiary tank 42 is always supplied with ink to a predetermined amount. However, the amount of ink in the subsidiary tank 42 falls below the predetermined amount after a large amount of ink is consumed at printing, for example. The process in FIG. 7 is executed in preparation for such a situation, in order to make the amount of ink in the subsidiary tank 42 at the predetermined amount when the user wishes to voluntarily perform the maintenance operation.

Normally, the knob 90 in the lock mechanism 14 is in the rotation restricted state. Thus, as shown in FIG. 7, when the user wishes to voluntarily perform the maintenance operation, the user presses the unlock switch 51 to indicate his/her intention to move the upper casing 11 to the open position. Upon pressing of the unlock switch 51, the unlock sensor 52 outputs the restriction cancel signal to the controller 1*p*. When the restriction cancel signal is outputted, the ink-amount determining section 74 determines whether the subsidiary tank 42 stores a predetermined amount of ink (that is, whether the ink storage amount is the predetermined amount or less than the predetermined amount) (S101). If the ink-amount determining section 74 determines that the subsidiary tank 42 does not store the predetermined amount of ink (the ink storage amount is less than the predetermined amount) (S101: No), the pump controlling section 72 drives the pump 43 to supply the subsidiary tank 42 with ink (S102) until the ink-amount determining section 74 determines that the subsidiary tank 42 stores the predetermined amount of ink (S101: Yes).

If the ink-amount determining section 74 determines that the subsidiary tank 42 stores the predetermined amount of ink (S101: Yes), the pump controlling section 72 stops driving of the pump 43 (S103). The lock controlling section 73 controls the solenoid 91 of the lock mechanism 14 to put the knob 90 in the rotation allowed state (S104). Subsequently, if the open/close sensor 16 detects that the upper casing 11 is returned to the closed position after the user performs the maintenance operation in a state where the upper casing 11 is at the open position (S105), the lock controlling section 73 controls the solenoid 91 of the lock mechanism 14 to put the knob 90 in the rotation restricted state (S106). Then, the flowchart in FIG. 7 ends. With this process, when the user pivotally moves the upper casing 11 for performing the maintenance operation, it is ensured that the subsidiary tank 42 stores the predetermined amount of ink and that a load (weight) for the user to pivotally move the upper casing 11 is constant. This prevents a situation in which the upper casing 11 is heavy and a load for the user is too large, and a situation in which the upper casing 11 is lighter than the user assumes and the upper casing 11 pivotally moves rapidly.

As described above, according to the printer 1 of the present embodiment, the subsidiary tanks 42 are arranged at each side of the inkjet head 2 with respect to the extending direction of the inkjet head 2. Hence, compared with a configuration in which all the subsidiary tanks 42 connected with one inkjet head 2 are arranged at one side of the inkjet head 2, the upper casing 11 has a better weight balance with respect to the extending direction, and twisting force acting on the pivoting mechanism can be reduced. With this configuration, a work space for jam recovery or the like can be opened easily. Further, compared with a configuration in which all the subsidiary tanks 42 are arranged in the sub-scanning direction D2, changes in the head differential can be suppressed during pivotal movement of the upper casing 11.

The four subsidiary tanks 42 are arranged in such a manner that there are two subsidiary tanks 42 at each side of the inkjet head 2 with respect to the main scanning direction D1. The ink supply ports 21 arranged at one side of the ejection surface with respect to the main scanning direction D1 are connected with the subsidiary tanks 42 arranged at the one side of the inkjet head 2 with respect to the main scanning direction D1 via the tubes 42*a*. The ink supply ports 21 arranged at the other side of the ejection surface with respect to the main scanning direction D1 are connected with the subsidiary tanks 42 arranged at the other side of the inkjet head 2 with respect to the main scanning direction D1 via the tubes 42*a*. Further, the four ink supply ports 21 are arranged to be point-symmetrical with respect to the center of the inkjet head 2. These configurations reduce differences in channel resistance and in positional relationship among the ejection ports 8 in communication with one subsidiary tank 42, and uniformize ejection characteristics of ink.

Further, the average position, with respect to the sub-scanning direction D2, of all the ejection ports 8 in communication with one subsidiary tank 42 matches the center position of the subsidiary tank 42 with respect to the sub-scanning direction D2. In addition, the arrangement sequence of the ejection-port arrays of the respective kinds of ink is the same for all the ejection blocks 80, and this arrangement sequence is the same as the arrangement sequence of the subsidiary tanks 42 with respect to the kinds of ink. These configurations suppress changes in the head differential between the subsidiary tank 42 and the corresponding ejection ports 8 when the upper casing 11 is pivotally moved, and suppress menisci in the ejection ports 8 from being broken.

In addition, because the inkjet head 2 and the subsidiary tank 42 are both fixed to the upper casing 11, the relative position between the both does not change. With this configuration, even if the upper casing 11 pivotally moves between the open position and the closed position, it is possible to reduce changes in relative position, with respect to the vertical direction D3, between the ejection surface of the inkjet head 2 and the liquid surface of the subsidiary tank 42. Further, this configuration can stabilize hydraulic head pressure of the inkjet head 2 (which is determined by the positional relationship between the inkjet head 2 and the subsidiary tank 42). Further, the subsidiary tank 42 has smaller volume than volume of the ink cartridge 41, which can suppress changes in load for pivotally moving the upper casing 11, the changes in load being created due to changes in the remaining amount of ink in the subsidiary tank 42. Thus, a work space for the maintenance operation or the like can be opened easily.

Further, the rigidity of the tube 43*a* that connects the ink cartridge 41 and the subsidiary tank 42 is lower than the rigidity of the tube 42*a* that connects the subsidiary tank 42 and the inkjet head 2. Hence, the tube 43*a* can easily follow pivotal movement of the upper casing 11. Further, because a material having good gas barrier characteristics can be used for the tube 42*a*, mixing of air into ink can be suppressed.

Further, when the upper casing 11 is located at the open position, the ink inlet port 42*i* is located at a higher position than the highest liquid level of ink stored in the subsidiary tank 42 with respect to the vertical direction D3. This configuration can suppress ink from flowing reversely from the subsidiary tank 42.

Further, the pump 43 is disposed at the lower casing 12 at the rear surface 4 side of the ink-cartridge mount section 41*a*. With this configuration, the weight of the upper casing 11 can be reduced. Further, because air is not introduced into the pump 43 at an initial introduction, a pump that can send ink but cannot send gas (non-self-priming pump) can be used, which increases options for the pump. That is, if the pump 43 is located at the lower casing 12 (more precisely, a position at which liquid in the ink cartridge 41 flows to the pump 43 due to its own weight), a non-self-priming pump as well as a self-priming pump can be selected. Note that, if the pump 43 is located at the upper casing 11 (more precisely, a position at which liquid in the ink cartridge 41 does not flow to the pump 43 due to its own weight), a self-priming pump should be selected. Here, the self-priming pump is a pump that has a mainly rubber-made check valve which is attached near a suction port of the pump, that has an air separation chamber, and that is configured to pump liquid only by priming the pump main body. In contrast, the non-self-priming pump is a pump that does not have self-priming capability using the suction check valve and the air separation chamber. Thus, except for a pushing operation (liquid flows into a pump), it is necessary to attach a foot valve to the distal end of a suction pipe, and to prime an entirety of the suction pipe.

Further, when the upper casing 11 is located at the closed position, the subsidiary tanks 42 and the ink cartridges 41 are arranged, in this sequence from the top, to overlap each other in a plan view, within the first range R1 not overlapping the inkjet head 2 with respect to the main scanning direction D1. The inkjet head 2, the platen 9, and the paper tray 20 are arranged, in this sequence from the top, to overlap each other in a plan view, within the second range R2 overlapping the inkjet head 2 with respect to the main scanning direction D1. And, when the upper casing 11 is located at the closed position, the subsidiary tanks 42 protruding from the lower side of the upper casing 11 are accommodated within the concave portion of the lower casing 12. Hence, each member is arranged efficiently, and the space of the printer 1 can be saved.

In addition, the four ink cartridges 41 are arranged at the same height, and the four subsidiary tanks 42 are arranged at the same height. Hence, the head differential between the ink cartridge 41 and the corresponding subsidiary tank 42 is made uniform, which can stabilize capability of supplying ink to the subsidiary tank 42.

Further, the same number of the subsidiary tanks 42 are arranged at each side of the inkjet head 2 with respect to the main scanning direction D1, which improves the weight balance of the upper casing 11.

<Modification>

Figure 8:
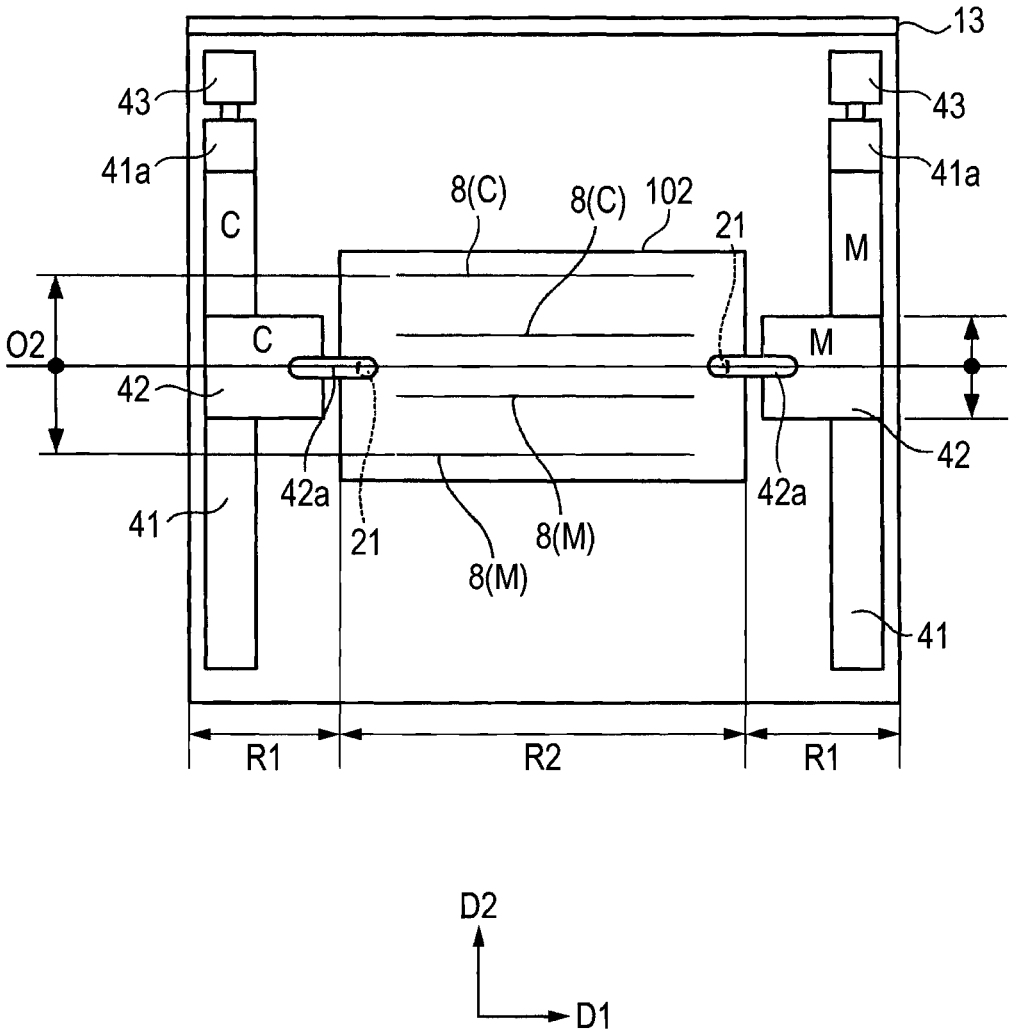
FIG. 8 is a schematic plan view showing a printer according to a modification.

In the above-described embodiment, the four ink cartridges 41 and the four subsidiary tanks 42 are connected with one inkjet head 2. However, the number of ink cartridges corresponding to one inkjet head 2 may be arbitrary. Also, the number of subsidiary tanks corresponding to one inkjet head 2 may be arbitrary. For example, as shown in FIG. 8, a printer may be configured so that ink is supplied to one inkjet head 102 from a pair of ink cartridges 41 and a pair of subsidiary tanks 42. Specifically, the subsidiary tank 42 of cyan (C) is disposed at the left side in FIG. 8 of the inkjet head 102, and the subsidiary tank 42 of magenta (M) is disposed at the right side in FIG. 8 of the inkjet head 102. Four ejection-port arrays are formed on the ejection surface of the inkjet head 102. Cyan ink is ejected from each ejection port 8 belonging to two ejection-port arrays at the rear surface side out of the four ejection-port arrays, and magenta ink is ejected from each ejection port 8 belonging to two ejection-port arrays at the front surface side. The two subsidiary tanks 42 are arranged at the same position with respect to the sub-scanning direction D2. Each subsidiary tank 42 is configured in such a manner that an average position O2, with respect to the sub-scanning direction D2, of all the ejection ports 8 belonging to the four ejection-port arrays matches a center position of each subsidiary tank 42 with respect to the sub-scanning direction D2. In this modification, although the two subsidiary tanks 42 are arranged at the same position with respect to the sub-scanning direction D2, the two subsidiary tanks 42 may be arranged at different positions with respect to the sub-scanning direction D2. Further, in FIG. 8, when the upper casing 11 is at the closed position, one ink cartridge 41 and one subsidiary tank 42 are arranged at each side of the inkjet head 2 with respect to the main scanning direction D1. Also, when the upper casing 11 is at the closed position, each ink cartridge 41 is arranged at the lower side of the corresponding subsidiary tank 42. This configuration improves the weight balance of the printer in the left-right direction (the main scanning direction D1). Further, because the head differential between the inkjet head 102 and the two subsidiary tanks 42 is made uniform, menisci formed in the ejection ports 8 can be stabilized. In this modification, although the one inkjet head 102 ejects ink of cyan and magenta, a combination of ink is not limited to this. Further, the one inkjet head 102 may eject ink of only one color.

Second Embodiment

A second embodiment of the invention will be described while referring to FIG. 9 wherein like parts and components are designated by the same reference numerals to avoid duplicating description. In the second embodiment, the configurations of an inkjet head 202 and subsidiary tanks 242 are different from the configurations of the inkjet head 2 and the subsidiary tanks 42 in the first embodiment, and will be mainly described below.

Figure 9:
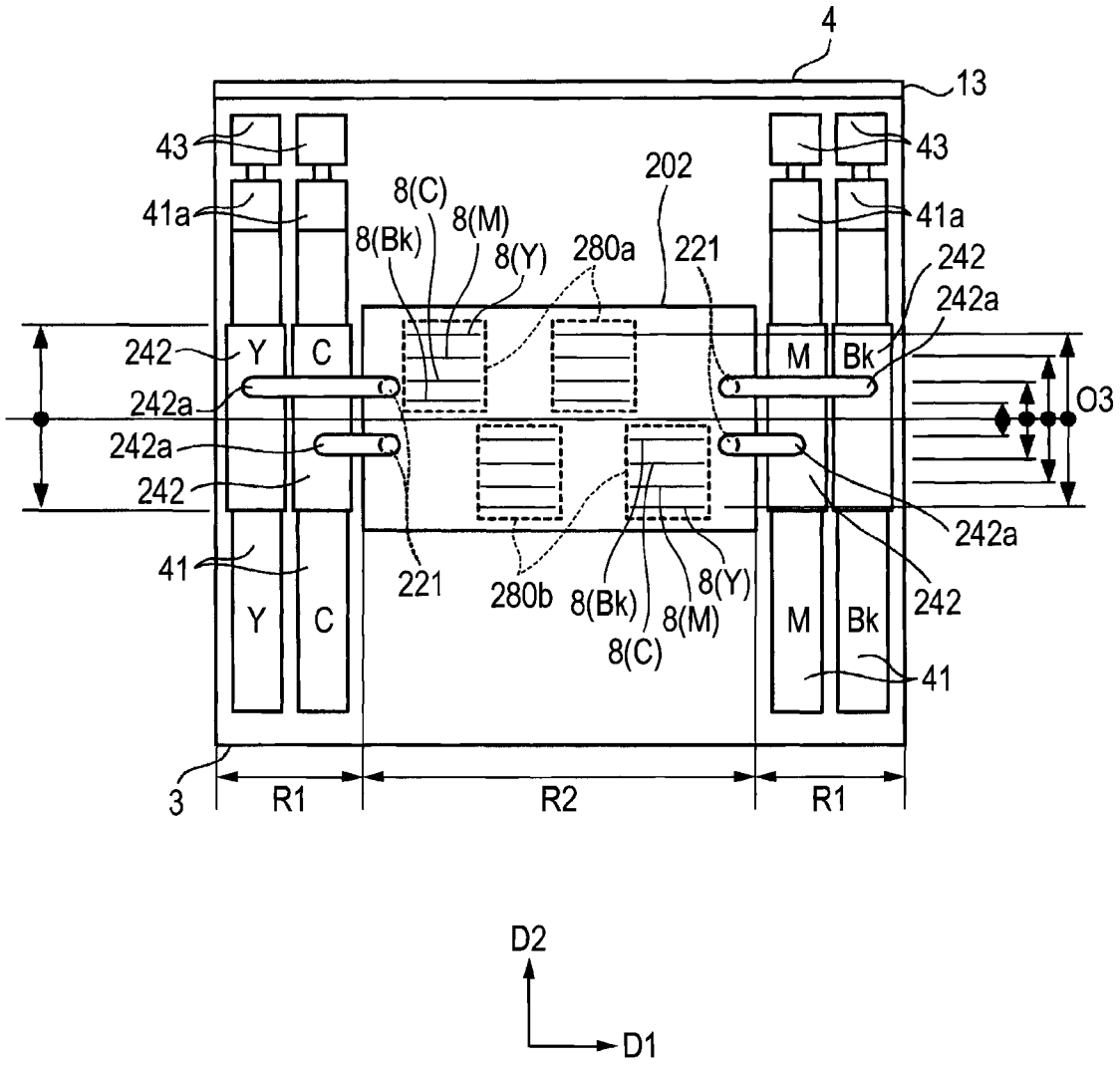
FIG. 9 is a schematic plan view showing a printer according to a second embodiment of the invention.

As shown in FIG. 9, the four subsidiary tanks 242 are fixed to the upper casing 11 in such a manner that two of the four subsidiary tanks 242 are arranged, in the main scanning direction D1, at each side of the inkjet head 202 with respect to the main scanning direction D1. Specifically, yellow and cyan subsidiary tanks 242 are arranged, from the left side in this sequence, at the upper casing 11 at the left side in FIG. 9 with respect to the main scanning direction D1. Similarly, magenta and black subsidiary tanks 242 are arranged, from the left side in this sequence, at the upper casing 11 at the right side in FIG. 9. When the upper casing 11 is located at the closed position, the ink cartridges 41 are arranged below the corresponding subsidiary tanks 242.

Four ink supply ports 221 are formed in an upper surface of the inkjet head 202. The four ink supply ports 221 are arranged to be point-symmetrical with respect to the center of the inkjet head 202. Four ejection blocks 280*a*, 280*b* in staggered arrangement with respect to the main scanning direction D1 are defined in the ejection surface of the inkjet head 202. The four ejection blocks 280*a*, 280*b* include two ejection blocks 280*a* and two ejection blocks 280*b* that are arranged at different positions with respect to the sub-scanning direction D2. The two ejection blocks 280*a* are arranged at the rear surface side, whereas the two ejection blocks 280*b* are arranged at the front surface side. Each of the ejection blocks 280*a* and 280*b* includes ejection-port arrays (ejection-port groups) for the respective ones of the ink cartridges 41, in other words, for kinds of ink (Y, C, M, Bk). In each of the ejection-port arrays, the ejection ports 8 are arranged at equal intervals in the main scanning direction D1. The four ejection-port arrays in each ejection block 280*a*, 280*b* are arranged in the sub-scanning direction D2, which is perpendicular to the main scanning direction D1. The arrangement sequence of the ejection-port arrays of the respective kinds of ink in the ejection blocks 280*a* (first block region) arranged at the rear surface 4 side (Y→M→C→Bk from the rear surface 4 side) is the opposite to the arrangement sequence of the ejection-port arrays of the respective kinds of ink in the ejection blocks 280*b* (second block region) arranged at the front surface side (Bk→C→M→Y from the rear surface 4 side). Specifically, in each of the two ejection blocks 280*a*, the four ejection-port arrays are arranged in the sequence of Y, M, C, Bk from the rear surface 4 side, with respect to the kinds of ink. On the other hand, in each of the two ejection blocks 280*b*, the four ejection-port arrays are arranged in the sequence of Y, M, C, Bk from the front surface 3 side, with respect to the kinds of ink. Further, an average position O3 (or its proximate position), with respect to the sub-scanning direction D2, of all the ejection ports 8 in communication with one subsidiary tank 242 matches a center position of that subsidiary tank 242 with respect to the sub-scanning direction D2. In this way, the four ejection-port arrays in each ejection block 280*a*, 280*b* are arranged in the sub-scanning direction D2, in such a manner that an average position, with respect to the sub-scanning direction D2, of all the ejection ports 8 for ejecting ink droplets of each kind (color) of ink is the same for all the kinds (colors) of ink with respect to the sub-scanning direction D2. Note that, in the present embodiment, the two subsidiary tanks 242 at the left side in FIG. 9 are arranged in the main scanning direction D1, and the two subsidiary tanks 242 at the right side in FIG. 9 are arranged in the main scanning direction D1. However, the two subsidiary tanks 242 may be arranged in the sub-scanning direction D2, like the subsidiary tanks 42 shown in FIG. 2B.

According to the above-described embodiment, the subsidiary tanks 242 are arranged at each side of the inkjet head 202 with respect to the extending direction of the inkjet head 202. Hence, compared with a configuration in which all the subsidiary tanks 242 connected with one inkjet head 202 are arranged at one side of the inkjet head 202, the upper casing 11 has a better weight balance with respect to the extending direction, and twisting force acting on the pivoting mechanism can be reduced. With this configuration, a work space for jam recovery or the like can be opened easily. Further, compared with a case in which all the subsidiary tanks 242 are arranged in the sub-scanning direction D2, changes in the head differential can be suppressed during pivotal movement of the upper casing 11.

Further, the above-described configuration suppresses changes in the head differential between the subsidiary tank 242 and the corresponding ejection ports 8 when the upper casing 11 is pivotally moved.

<Other Modifications>

While the invention has been described in detail with reference to the above aspects thereof, it would be apparent to those skilled in the art that various changes and modifications may be made therein without departing from the scope of the claims.

For example, in the above-described embodiment, the subsidiary tanks 42, 242 are arranged in such a manner that there are two subsidiary tanks at each side of the inkjet head 2, 202 with respect to the main scanning direction D1 (two subsidiary tanks at each side). However, three or more subsidiary tanks may be arranged in such a manner that the same number or different numbers of subsidiary tanks are arranged at each side of the inkjet head with respect to the main scanning direction D1. In a case where different numbers of subsidiary tanks are arranged at each side, it is preferable that the difference between the number of subsidiary tanks at one side and the number of subsidiary tanks at the other side be one (1).

In the above-described embodiment, the four ink supply ports 21 are arranged to be point-symmetrical with respect to the center of the inkjet head 2. However, the ink supply ports 21 may be arranged at any positions. For example, the ink supply ports 21 may be arranged to be line-symmetric.

In the above-described embodiment, the rigidity of the tube 43*a* that connects the ink cartridge 41 and the subsidiary tank 42 is lower than the rigidity of the tube 42*a* that connects the subsidiary tank 42 and the inkjet head 2. However, the relationship of rigidity of each tube may be arbitrarily.

In the above-described embodiment, the ink inlet port 42*i* is formed at a position on the upper surface of the subsidiary tank 42, the position being farthest away from the pivotal shaft 13. However, the ink inlet port may be formed at a different position.

In the above-described embodiment, the pump 43 is disposed at the bottom portion of the lower casing 12 at the rear surface 4 side of the ink-cartridge mount section 41*a*. However, the pump 43 may be disposed at any position. For example, the pump 43 may be disposed at the upper casing 11.

In the above-described embodiment, the subsidiary tank 42 protrudes from the lower surface of the upper casing 11. However, it is not necessary that the subsidiary tank 42 protrude from the lower surface of the upper casing 11.

In the above-described embodiment, the four ink cartridges 41 are arranged at the same height, and the four subsidiary tanks 42 are arranged at the same height. However, the four ink cartridges 41 may be arranged at different heights. Similarly, the four subsidiary tanks 42 may be arranged at different heights.

In the above-described embodiment, the one inkjet head 2 ejects ink droplets of four colors. However, a plurality of inkjet heads may be provided to eject ink droplets of respective colors. That is, the inkjet heads may be independent for each color. In this configuration, the ink cartridge 41 and the subsidiary tank 42 are provided for each of the plurality of inkjet heads. For example, at least one of the plurality of inkjet heads is connected to two subsidiary tanks 42 arranged at the both sides (one at each side) of the inkjet head with respect to the main scanning direction D1.

Figure 10:
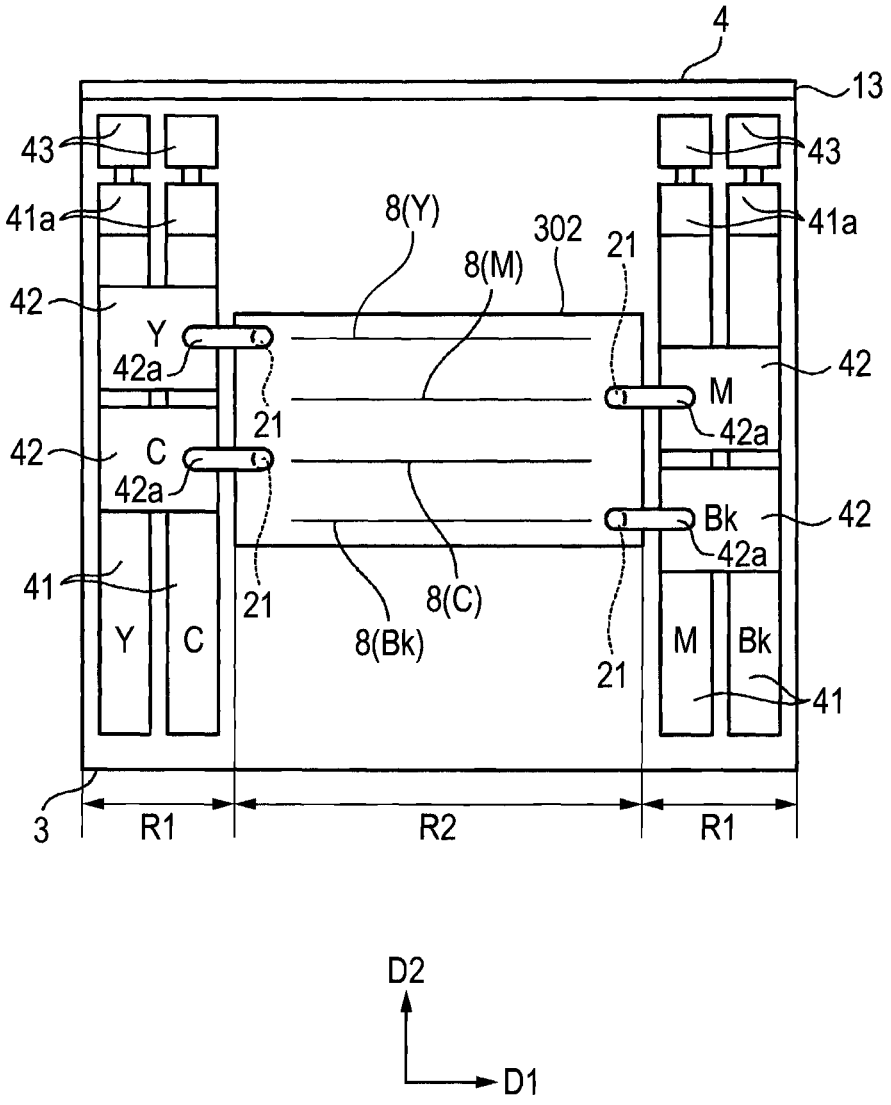
FIG. 10 is a schematic plan view showing a printer according to another modification.

Further, ink channels within the inkjet head may have an arbitrary configuration. For example, in the above-described embodiments, the ejection blocks 80, 280*a*, and 280*b* are defined in staggered arrangement on the ejection surface. However, positions at which the ejection ports 8 are arranged are not limited to this configuration. For example, as shown in FIG. 10, in an inkjet head 302, the ejection ports 8 of each color may be arranged linearly in the main scanning direction D1. With this configuration, an average position, with respect to the sub-scanning direction D2, of all the ejection ports 8 in communication with one subsidiary tank 42 matches a center position of that subsidiary tank 42 with respect to the sub-scanning direction D2.

Alternatively, the average position, with respect to the sub-scanning direction D2, of all the ejection ports 8 in communication with one subsidiary tank 42 may be different from the center position of that subsidiary tank 42 with respect to the sub-scanning direction D2. In this case, the following configuration is preferred. A plurality of ejection-port arrays of the inkjet head 2 for ejecting different kinds of ink is arranged in a sequence of Y, M, C, and Bk from the rear surface 4 side. The subsidiary tanks 42 are also arranged in a sequence of Y, M, C, and Bk from the rear surface 4 side. Note that the arrangement sequence of all the subsidiary tanks 42 does not have to match the arrangement sequence of the ejection-port arrays. For example, the printer may be so configured that the arrangement sequence of the subsidiary tanks 42 arranged at the left side (FIG. 10) of the inkjet head 2 matches the arrangement sequence of the ejection-port arrays of the respective kinds of ink, and that the arrangement sequence of the subsidiary tanks 42 arranged at the right side (FIG. 10) of the inkjet head 2 matches the arrangement sequence of the ejection-port arrays of the respective kinds of ink.

Further, an inkjet head may be configured to eject ink droplets of a single color. In this configuration, subsidiary tanks arranged at the both sides of the inkjet head with respect to the main scanning direction D1 store ink of the same color. In this way, ink of a single color is supplied from two subsidiary tanks, thereby increasing the amount of ink per unit time that can be ejected from the inkjet head.

In the above-described embodiment, the platen 9 is disposed to confront the ejection surface of the inkjet head 2, and the paper conveying mechanism supporting a recording medium with rollers is provided. However, a supporting section is not limited to this configuration. For example, a belt conveying mechanism may be adopted in which an endless belt is circularly-movably looped around a plurality of rollers arranged at the upstream and downstream sides of the inkjet head 2 with respect to the conveying direction, and conveys paper supported on a surface of the endless belt. In this configuration, the surface of the endless belt supporting paper constitutes the supporting section.

The invention is not limited to a printer, but is applicable to a facsimile apparatus, a copier, and the like. Liquid ejected from the head is not limited to ink, but may be any liquid. The recording medium is not limited to paper P, but may be any medium on which recording can be performed.

What is claimed is:

1. A liquid ejecting apparatus comprising:

at least one first-tank mount section configured so that at least one first tank storing liquid is mounted thereon;

a plurality of second tanks;

at least one liquid ejecting head elongated in a predetermined direction, the at least one liquid ejecting head having an ejection surface formed with a plurality of ejection ports configured to eject liquid;

a supporting section disposed in confrontation with the ejection surface and configured to support a recording medium;

a first frame holding the at least one liquid ejecting head and the plurality of second tanks; and a second frame holding the supporting section, wherein the first frame is coupled to the second frame in such a manner that the first frame is movable relative to the second frame, the first frame being configured to take a first position at which the ejection surface confronts the supporting section and a second position at which the ejection surface is farther spaced away from the supporting section than at the first position;

wherein the plurality of second tanks is connected to the at least one first-tank mount section so that each of the plurality of second tanks is supplied with liquid stored in a corresponding one of the at least one first tank in a state where the at least one first tank is mounted on the at least one first-tank mount section;

wherein one of the at least one liquid ejecting head is connected to at least two of the plurality of second tanks so that liquid stored in each of the at least two of the plurality of second tanks is supplied to the one of the at least one liquid ejecting head; and wherein at least two of the plurality of second tanks connected to the one of the at least one liquid ejecting head are arranged in such a manner that there is at least one second tank at each side of the one of the at least one liquid ejecting head with respect to the predetermined direction.

2. The liquid ejecting apparatus according to claim 1, wherein the one of the at least one liquid ejecting head is formed with a plurality of supply ports through which liquid is supplied;

wherein at least one of the plurality of supply ports formed at one side of a center of the ejection surface with respect to the predetermined direction is connected to at least one of the plurality of second tanks arranged at the one side of the at least one liquid ejecting head; and wherein at least one of the plurality of supply ports formed at an other side of the center of the ejection surface with respect to the predetermined direction is connected to at least one of the plurality of second tanks arranged at the other side of the at least one liquid ejecting head.

3. The liquid ejecting apparatus according to claim 2, wherein the one of the at least one liquid ejecting head is connected to an even number of second tanks;

wherein the even number of second tanks is arranged in such a manner that a same number of the even number of second tanks is arranged at each side of the one of the at least one liquid ejecting head with respect to the predetermined direction; and wherein the plurality of supply ports is arranged to be point-symmetrical with respect to the center of the ejection surface.

4. The liquid ejecting apparatus according to claim 1, wherein the plurality of second tanks is arranged in such a manner that a center position of each of the plurality of second tanks is the same as an average position of the plurality of ejection ports connected to a corresponding one of the plurality of second tanks, with respect to a perpendicular direction that is perpendicular to the predetermined direction in a plane in parallel with the ejection surface.

5. The liquid ejecting apparatus according to claim 1, wherein the one of the at least one liquid ejecting head is connected to at least three second tanks;

wherein the ejection surface has a plurality of ejection-port groups each including a plurality of ejection ports that ejects liquid of the same characteristics and that is arranged at equal intervals in the predetermined direction, a number of the plurality of ejection-port groups being the same as a number of the at least three second tanks connected to the one of the at least one liquid ejecting head; and wherein at least two of the at least three second tanks arranged at at least one of one side and another side of the at least one liquid ejecting head are arranged in the perpendicular direction, in such a manner that an arrangement sequence, with respect to the perpendicular direction, of the at least two of the at least three second tanks is the same as an arrangement sequence of at least two of the plurality of ejection-port groups connected to respective ones of the at least two of the at least three second tanks.

6. The liquid ejecting apparatus according to claim 5, wherein the ejection surface has a plurality of block regions that is arranged in staggered arrangement along the predetermined direction, each of the plurality of block regions having the plurality of ejection-port groups; and wherein the plurality of ejection-port groups is arranged in the perpendicular direction, in such a manner that an arrangement sequence, with respect to the perpendicular direction, of the plurality of ejection-port groups that ejects liquid of different characteristics in each of the plurality of block regions is the same for all of the plurality of block regions.

7. The liquid ejecting apparatus according to claim 6, wherein the plurality of ejection-port groups in each of the plurality of block regions is arranged in the perpendicular direction, in such a manner that an average position, with respect to the perpendicular direction, of all of the plurality of ejection ports that eject liquid of the same characteristics is different for each characteristics of liquid; and wherein the at least three second tanks are arranged in such a manner that a center position of each of the at least three second tanks is the same as an average position, with respect to the perpendicular direction, of all of the plurality of ejection ports connected to a corresponding one of the at least three second tanks.

8. The liquid ejecting apparatus according to claim 5, wherein the at least three second tanks connected to the one of the at least one liquid ejecting head are arranged in such a manner that an arrangement sequence of the at least three second tanks with respect to the perpendicular direction is the same as an arrangement sequence, with respect to the perpendicular direction, of at least three of the plurality of ejection-port groups connected to respective ones of the at least three second tanks.

9. The liquid ejecting apparatus according to claim 5, wherein the plurality of ejection-port groups is arranged in the perpendicular direction, in such a manner that an average position, with respect to the perpendicular direction, of all of the plurality of ejection ports that eject liquid of the same characteristics is different for each characteristics of liquid; and wherein the at least three second tanks are arranged in such a manner that a center position of each of the at least three second tanks is the same as an average position, with respect to the perpendicular direction, of all of the plurality of ejection ports connected to a corresponding one of the at least three second tanks.

10. The liquid ejecting apparatus according to claim 1, wherein the ejection surface has a plurality of block regions that is arranged in staggered arrangement along the predetermined direction;

wherein the plurality of block region has at least one first block region and at least one second block region that is arranged at a different position from the at least one first block region with respect to a perpendicular direction that is perpendicular to the predetermined direction;

wherein each of the plurality of block regions has a plurality of ejection-port groups each including a plurality of ejection ports that ejects liquid of the same characteristics and that is arranged at equal intervals in the predetermined direction, a number of the plurality of ejection-port groups being the same as a number of the plurality of second tanks connected to the one of the at least one liquid ejecting head;

wherein the plurality of ejection-port groups in the at least one second block region is arranged in the perpendicular direction, in such a manner that an arrangement sequence, with respect to the perpendicular direction, of the plurality of ejection-port groups that ejects liquid of different characteristics is opposite to an arrangement sequence of the plurality of ejection-port groups in the at least one first block region;

wherein the plurality of ejection-port groups in each of the plurality of block regions is arranged in the perpendicular direction, in such a manner that an average position, with respect to the perpendicular direction, of all of the ejection ports that eject liquid of the same characteristics is the same for each characteristics of liquid; and wherein each of the at least two of the plurality of second tanks connected to the one of the at least one liquid ejecting head is arranged adjacent to the average position with respect to the perpendicular direction.

11. The liquid ejecting apparatus according to claim 10, wherein the one of the at least one liquid ejecting head is connected to at least three second tanks; and wherein at least two of the at least three second tanks are arranged, in the predetermined direction, at at least one of one side and another side of the one of the at least one liquid ejecting head, in such a manner that a center position of each of the at least two of the at least three second tanks is the same as the average position with respect to the perpendicular direction.

12. The liquid ejecting apparatus according to claim 1, wherein each of the plurality of second tanks has smaller volume than volume of the at least one first tank; and wherein the second frame further holds the at least one first-tank mount section.

13. The liquid ejecting apparatus according to claim 1, further comprising:

a first tube configured to allow communication between the at least one first tank and the plurality of second tanks in a state where the at least one first tank is mounted on the at least one first-tank mount section; and a second tube configured to allow communication between the plurality of second tanks and the at least one liquid ejecting head, wherein the first tube has lower rigidity than rigidity of the second tube.

14. The liquid ejecting apparatus according to claim 1, further comprising a pump configured to send, to the plurality of second tanks, liquid stored in the at least one first tank in a state where the at least one first tank is mounted on the at least one first-tank mount section, wherein the second frame further holds the pump.

15. The liquid ejecting apparatus according to claim 1, wherein each of the plurality of second tanks is formed with an inlet port through which liquid supplied from the at least one first tank flows in; and wherein, when the first frame is located at the second position, the inlet port is located at a higher position than a highest liquid surface of liquid stored in each of the plurality of second tanks with respect to a vertical direction.

16. The liquid ejecting apparatus according to claim 1, wherein the at least one first-tank mount section comprises a pair of first-tank mount sections, and the plurality of second tanks comprises a pair of second tanks;

wherein the pair of first-tank mount sections and the pair of second tanks are configured so that liquid is supplied from one first tank mounted on one of the pair of first-tank mount sections to the one of the at least one liquid ejecting head via one of the pair of second tanks, and that liquid is supplied from another first tank mounted on another one of the pair of first-tank mount sections to the one of the at least one liquid ejecting head via another one of the pair of second tanks;

wherein the pair of second tanks connected to the one of the at least one liquid ejecting head is arranged in such a manner that there is one second tank at each side of the one of the at least one liquid ejecting head with respect to the predetermined direction; and wherein, in a state where the first frame is located at the first position, each of the pair of first tanks is arranged at a lower side of a corresponding one of the pair of second tanks with respect to a vertical direction.

17. The liquid ejecting apparatus according to claim 1, wherein the at least one first-tank mount section comprises a plurality of first-tank mount sections;

wherein the liquid ejecting apparatus further comprises a recording-medium accommodating section configured to accommodate a plurality of recording mediums;

wherein a first range is defined as a range, with respect to the predetermined direction, other than a range in which the at least one liquid ejecting head extends, and a second range is defined as a range, with respect to the predetermined direction, in which the at least one liquid ejecting head extends;

wherein, when the first frame is located at the first position, the plurality of second tanks and the at least one first tank are arranged to overlap each other in a plan view in this order from top within the first range, and the at least one liquid ejecting head, the supporting section, and the recording-medium accommodating section are arranged to overlap each other in a plan view in this order from top within the second range; and wherein each of the plurality of second tanks protrudes downward from a lower end of the first frame, and the second frame is formed with a concave portion in which each of the plurality of second tank is inserted in a state where the first frame is located at the first position.

18. The liquid ejecting apparatus according to claim 1, wherein a same number of the plurality of second tanks is arranged at each side of the at least one liquid ejecting head with respect to the predetermined direction.

19. The liquid ejecting apparatus according to claim 1, wherein a first number of the plurality of second tanks is arranged at one side of the at least one liquid ejecting head with respect to the predetermined direction, and a second number of the plurality of second tanks is arranged at another side of the at least one liquid ejecting head with respect to the predetermined direction; and wherein a difference between the first number and the second number is one (1).

* * * * *